United States Patent [19]

Akimoto et al.

[11] 4,456,528

[45] Jun. 26, 1984

[54] PROCESS FOR REMOVING ASH FROM COAL

[75] Inventors: Hidetoshi Akimoto, Ibaraki; Ryuichi Kaji, Kitaibaraki; Takeo Komuro, Hitachi; Yasushi Muranaka, Katsuta; Hideo Kikuchi, Hitachi; Yukio Hishinuma, Hitachi; Fumito Nakajima, Hitachi; Hiroshi Terada, Hiroshima, all of Japan

[73] Assignees: Hitachi, Ltd.; Babcock-Hitachi Kabushiki Kaisha, both of Tokyo, Japan

[21] Appl. No.: 320,091

[22] Filed: Nov. 10, 1981

[30] Foreign Application Priority Data

Nov. 18, 1980 [JP] Japan ..... 55-162839

[51] Int. Cl.[3] ..... B07B 13/00

[52] U.S. Cl. ..... 209/49; 209/170; 209/171; 210/704

[58] Field of Search ..... 209/5, 49, 158–161, 209/170, 171; 44/1 R, 10 F; 210/703–705

[56] References Cited

U.S. PATENT DOCUMENTS

| | | | |
|---|---|---|---|
| 787,814 | 4/1905 | Wolf | 209/171 |
| 2,744,626 | 5/1956 | Reerink et al. | 209/49 |
| 3,045,818 | 7/1962 | Muschenborn et al. | 209/49 |
| 4,089,776 | 5/1978 | McMurray | 209/49 X |
| 4,272,250 | 6/1981 | Burk, Jr. et al. | 209/5 X |
| 4,288,231 | 9/1981 | Taylor | 44/1 R X |
| 4,332,593 | 6/1982 | Burgess et al. | 44/1 R X |

FOREIGN PATENT DOCUMENTS

| | | | |
|---|---|---|---|
| 531380 | 10/1956 | Canada | 209/49 |
| 903853 | 8/1962 | United Kingdom | 209/5 |

*Primary Examiner*—Richard L. Chiesa
*Attorney, Agent, or Firm*—Mary Louise Beall

[57] ABSTRACT

Mineral impurities can be effectively removed from coal by introducing oil droplets into an aqueous slurry of pulverized coal. Coal, which is lipophilic, attaches to the surface of the oil droplets and floats upwardly along with the oil droplets utilizing their buoyancy. On the other hand, mineral impurities, which are hydrophilic, are left in the aqueous slurry.

11 Claims, 4 Drawing Figures

PROCESS FOR REMOVING ASH FROM COAL

BACKGROUND OF THE INVENTION

1. Field of the invention

This invention relates to a process for removing mineral impurities from coal, and more particularly to a process for removing mineral impurities from coal by introducing oil droplets to an aqueous slurry of pulverized coal, thus attaching coal, which is lipophilic, directly to the interface of the oil droplets, and floating it utilizing the buoyancy of the oil droplets, while leaving mineral impurities, which are hydrophilic, in the aqueous slurry.

2. Description of the Prior Art

The presence of mineral impurities (hereinafter, referred to as ash) mixed in the coal is a universal matter and also a great objection in the application of coal. Separation and removal of ash in coal in advance is indispensable in that this not only alleviates measures for preventing the environmental pollution ensuring the evolution of dust and sulfur oxides, but also reduces the corrosion or abrasion of equipment during combustion and further contributes to the stability of combustion. Moreover, the range of types of coal usable, although restricted in the present situation depending upon impurities therein, will be largely expanded by the prior removal of impurities. The removal of ash prior to shipping is also beneficial in respect to the reduction of shipping cost. From these points of view, it is taken as an important technique in diversified applications of coal to separate and remove the impurity ash from coal in advance. Thus a variety of ash removal techniques have been proposed recently.

The processes hitherto proposed for removing ash from coal involve physical treatments to remove the ash separated in crushing coal, by utilizing its difference from coal itself in physical properties such as specific gravity, surface properties, or electromagnetic properties; and chemical treatments to extract ash by the action of acids, alkalis, or other reagents.

The chemical treatments, of which the primary object is the removal of sulfur, cannot result in sufficient removal of ash because such reagents are comparatively inactive to silicate minerals which are principal components of the ash in coal.

In said physical treatments the ash particles, which are independent of coal particles, are removed. The coal usually contains 10–30% by weight of ash, of which particle size and dispersion state in the raw coal vary depending upon the kind of coal. Although distributed sometimes non-uniformly in the form of striae or of spots as particles of hundreds $\mu$ in size or as agglomerates of particles of several $\mu$ in particle size, the ash is generally distributed more uniformly as fine particles of several to several scores $\mu$ or more. Accordingly, the more finely coal is ground, the easier the separation of the ash becomes. It is desirable to grind coal as finely as several $\mu$ or less. but it is impractical since the grinding cost becomes too high. The usual particle sizes of coal ground are scores $\mu$, for example, in the pulverized coal for combustion purposes, 70–80% by weight of the coal has a size of 70$\mu$ or less. At any rate, it is necessary in order to reduce ash content to a reasonable level to grind coal to a particle size of at least a score of $\mu$.

As processes for removing ash selectively from such pulverized coal, there are simple ones such as cyclone separation and artificial separation (elutriation) which utilize difference in specific gravity. These processes, utilizing difference in specific gravity, however, have the disadvantage that the separation of ash is difficult, although coal and its ash have different specific gravities, and the removal of ash is unsatisfactory on accout of nonuniform shapes of the pulverized particles and a wide distribution of particle size.

Another process proposed for removing ash from pulverized coal is the oil agglomeration process utilizing the difference in surface properties between ash and pure coal, that is, utilizing the fact that the coal is originally an organic substance and has a lipophilic nature whereas the ash is intrinsically inorganic substance and has a hydrophilic nature. This process comprises adding an oil as a binder to an aqueous slurry of pulverized coal, stirring the mixture vigorously to form granules or pellets from pure coal and the oil, and at the same time, allow the ash to remain in water, and recovering the granules or pellets by separation through screens.

This oil agglomeration process has the disadvantage of a limited efficiency of recovering ash, because water in which ash is dispersed is contained in the interstices among the coal granules and the separation of these ashes is difficult. The amount of water in the interstices among the coal granules depends upon the amount of oil added and when the latter amount increases, the interstices will be filled with the oil, and in consequence the ash content in the recovered coal can be reduced, but the reduction is unsatisfactory in that the percentage of ash removal is as low as 10–50%. Considering that the coal contains ash in amounts of as much as 10–50% by weight depending upon the kind of coal, a percentage of ash removal of this degree can not achieve adequately the object of effective utilization of coal and of prevention of environmental pollution.

Froth flotation is another process for removing ash from pulverized coal. In this process, air is bubbled through an aqueous slurry of pulverized coal while stirring it, whereby pure coal particles are attached to air bubbles because their surface is hydrophobic, and ash particles are left in water since their surface is hydrophillic. The pure coal particles attached to air bubbles are floated by the buoyancy of air bubbles to the surface of the aqueous slurry to form froth and are recovered as separated pure coal. Thus ash in the raw coal is removed. In this froth floatation process, coating of coal particles with an oil in advance is practiced for the purpose of improving the adhesiveness of coal particles to air bubbles. In this case, the affinity between coal and oil and the affinity between oil and air become an issue, and in order to enhance the two affinities, not only the selection of oil but also the setting of a variety of intricate conditions are necessary such as pH and temperature of slurry, additives, amount of air supplied, and size of air bubbles. In addition, the yield of coal recovery and the percentage of ash removal are not always satisfactory even when such intricate conditions are established.

In this froth floatation process, since vigorous stirring is generally performed, like the above-mentioned oil agglomeration process, the aqueous slurry containing ash is carried along with the floating coal particles, thus lowering the percentage of ash removal.

In the froth floatation process, although pulverized coal is generally preferred to have smaller particle sizes for obtaining a higher percentage of ash removal, ash tends to be carried with air bubbles and form scum on the slurry phase when the particle size of pulverized coal is too small.

BRIEF SUMMARY OF THE INVENTION

The object of this invention is to provide a process for removing ash from coal which is free from such disadvantages of the conventional processes as described above and permits effective removal of ash and recovery of pure coal from aqueous slurry of pulverized coal.

Said object of the invention has been achieved by a process for removing ash from coal which comprises grinding raw coal to fine particles, then dispersing them in water to form an aqueous slurry, and introducing oil droplets into said slurry to attach pure coal to ascending oil droplets and float it along with them, whereby pure coal is concentrated in the oil phase formed above the slurry and is recovered and at the same time ash is left and concentrated in water.

DETAILED DESCRIPTION OF THE INVENTION

Figure 1:
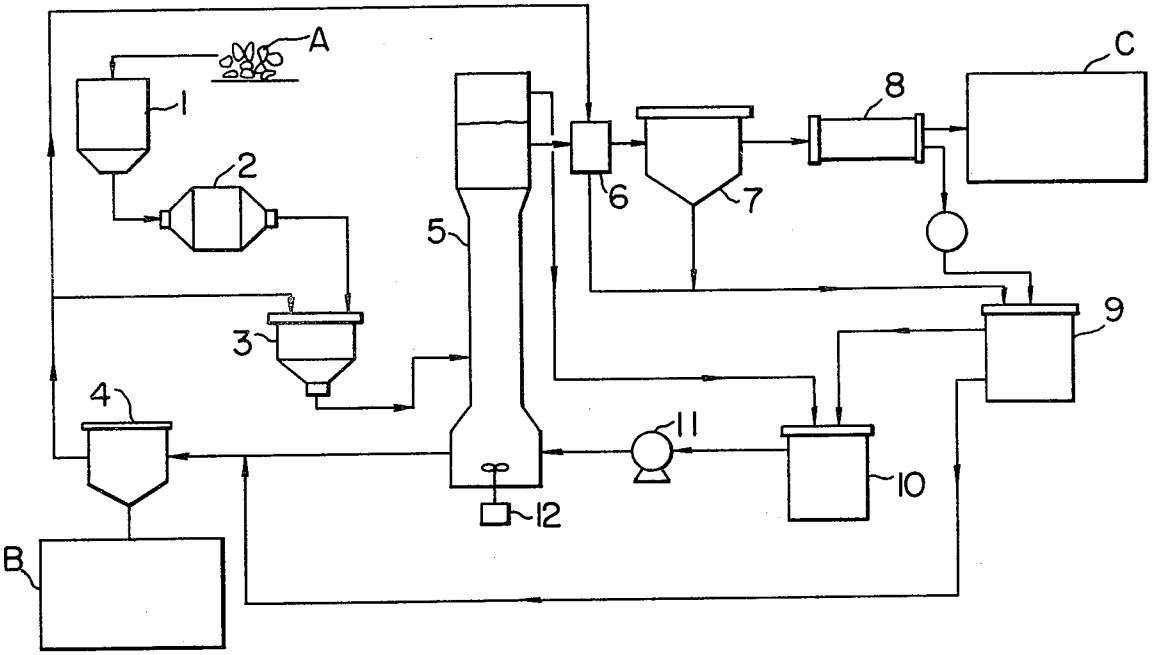
FIG. 1 is an illustration of the whole construction of apparatus suitable for carrying out the process for removing ash from coal of this invention.

The process of this invention is characterized in that droplets of an oil having a specific gravity smaller than that of water are introduced in an aqueous slurry of pulverized coal to attach pure coal particles, which are lipophilic, to the oil droplets and float the coal particles utilizing the buoyancy of oil droplets, and the present process should be clearly distinguished from the conventional froth floatation process utilizing the buoyancy of air bubbles. As stated above, while the conventional froth floatation process, having an issue in the affinities between coal and oil and between oil and air, requires the setting of various intricate conditions, the present process basically requires attention to only the affinity between coal and oil, therefore markedly simplifying the setting of operational conditions. In addition, whereas the conventional froth floatation process requires coating coal particles in advance with oil, the present process does not require it. Still further, unlike the conventional oil agglomeration and froth flotation processes, the present process does not require vigorous stirring, resulting in not only simplication of apparatus and reduction of running cost but also less amounts of ashes floated along with pure coal.

In the process of this invention, since coal particles attach to the surface of oil droplets, coal particles do not combine with one another in the aqueous slurry and hence no phenomenon such as the holding of ash-containing water in the interstices between coal particles occur other than the holding of the surface water of coal particles. This held surface water separates gradually along with the aggregation of coal particles due to the binding effect of the oil, by allowing the slurry of recovered coal in oil to stand for a short time. These aggregation of coal particles and separation of water are promoted by stirring, so that in practice mild stirring is preferred to be effected.

The oil used in this invention is preferably to be water-insoluble and lighter than water. In order to reduce the consumption of oil, it is desirable to recover the oil by evaporation, by heating or reducing pressure of the oil in which coal has been concentrated.

This invention will be further illustrated below referring to the drawings.

FIG. 1 is a flow sheet showing the outline of whole construction of apparatus suited for carrying out the process for removing ash from coal of this invention. The apparatus shown in FIG. 1 is roughly divided into a coal grinding section, a section for separating pure coal from ash by oil floatation, and an oil recovery section.

Referring to FIG. 1, raw coal (lumps of coal) A is fed into a hopper 1 and in turn from said hopper to a grinder 2. Ash particles contained in coal lumps have small sizes, mostly of 1 mm or less in diameter. By grinding the coal lumps A into fine particles in the grinder 2, ash particles larger than pulverized coal particles can be separated therefrom, but ash particles comparable to or smaller than coal particles remain in the coal fraction.

Figure 2:
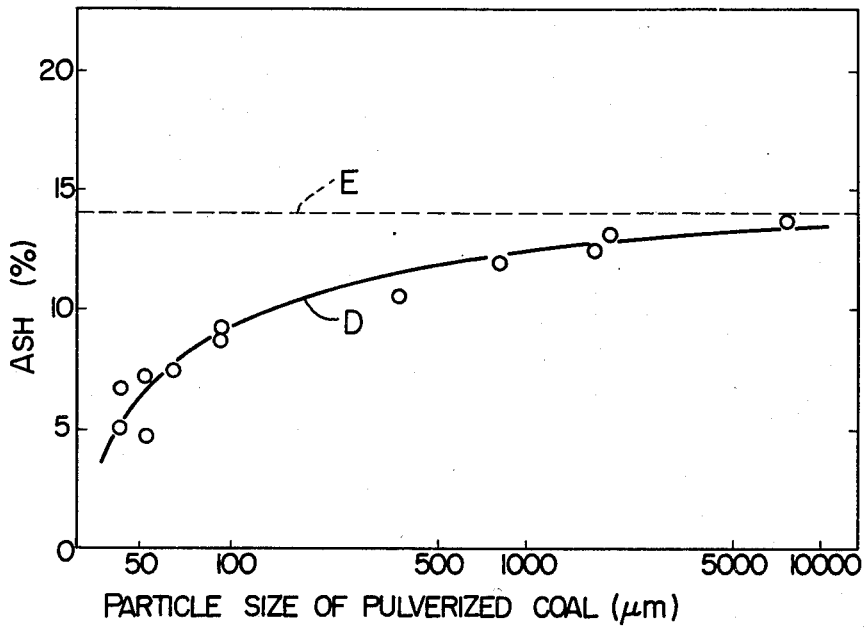
FIG. 2 is a graph to illustrate the relation of ash contents in pulverized coal particles (carbonaceous ash contents) to particle sizes of pulverized coal.

FIG. 2 is a graph illustrating results of measuring the respective ash contents (% by weight) remaining in coal fractions after the ground coal was subjected to classification and then the classified groups of particles were subjected separately to heavy-medium separation to remove relatively large ash particles. In FIG. 2, a size of the abscissa indicates the particle size ($\mu$) of each classified coal fraction, a size of the ordinate indicates the content of ash (% by weight) remaining in each classified coal fraction, and curve D indicates the change of content of ash (% by weight) remaining in the coal fraction with varying particle size of the coal fraction. Dotted line E in FIG. 2 indicates the total amount of ash in the raw coal used. As is apparent from FIG. 2, the content of ash remaining in the coal fraction decreases as a matter of course, as raw coal lumps are ground more finely.

Accordingly, it is desirable to grind raw coal lumps as finely as possible in the grinder 2 shown in FIG. 1, for example, to a maximum particle size of 100$\mu$ or less, preferably 70$\mu$ or less. The prefered average particle size is 30–40$\mu$.

The coal finely ground in the grinder 2 is fed into a mixer 3, to which water from a thickener 4 is also fed. In the mixer 3, the finely ground coal is turned into an aqueous slurry, namely the state of mixture with water. Next, the aqueous slurry is supplied to a separation column 5, to which the oil from an oil tank 10 is fed to the bottom of the column through an oil feed pump 11. The oil injected at the bottom into the separation column ascends the interior of said column in the form of droplets, where coal particles, which are lipophilic, are preferentially attached and move to the column top along with oil droplets. In contrast, ash, which is hydrophilic, remains in the aqueous slurry without adhering to oil droplets. Thus, coal and ash fractions of raw coal can be separated.

The surface area of oil in the separation column 5 is preferred to be as large as possible since to said surface the finely divided coal must be attached in the separation column 5. In other words, the oil droplet size is preferable to be minimized, and the desirable range thereof is from 0.1 to 7 mm. In order to obtain finely dispersed oil droplets, it is desirable to inject the oil through a nozzle with a small diameter.

With this means alone, however, there is a limitation, so it is desirable to mildly stir the portion of slurry near the oil inlet port of the bottom of the separation column 5 is by a stirrer 12, in order to produce further fine oil droplets. In this way, coal particles are concentrated in the oil phase formed above the slurry phase in the separation column 5.

The mixture of coal and oil floated to the top of the separation column 5 is successively led to a washing tank 6, wherein some attached ash is removed. The mixture of coal and oil freed from attached ash is then separated by a filter 7 into coal and oil. The coal is further led to a dryer 8, wherein remaining oil and water are further removed by heating or reducing pressure. The oil and water separated off in the filter 7 and dryer 8 are led to a tank 9 and recovered. The oil and water separated off in the washing tank 6 are also led to the tank 9 and recovered. The oil and water led into the tank 9 are separated therein, and the separated oil is recycled through the oil tank 10 and oil feed pump 11 to the separation column 5, and the separated water is recycled through the thickener 4 and mixer 3 to the separation column 5. Thus, both the oil and water are reused.

Since coal particles are attached to oil droplets in the apparatus for removing ash from coal shown in FIG. 1, a relatively large amount of oil, though dependent upon the oil particle size, is introduced for the purpose of enhancing the recovery yield of coal. For example, when oil droplets of about 0.5 mm in diameter are introduced, the necessary amount of oil is usually 5–10 times the amount of pure coal, though dependent upon the kind of coal. However, this presents no problems since the oil in the present process forms a simple mixture with coal, and hence readily separated therefrom to reuse in the state not containing coal.

The oils usable in the apparatus for removing ash from coal shown in FIG. 1 are those which as water-insoluble and lighter than water, as well as have an affinity to coal, such as, for example, gasoline, kerosene, light oil, heavy oil, diesel oil, liquids produced by coal carbonization, and vegetable oils. Of these oils, there is no particular limitation in kind of oil. From these oils, a suitable one can be selected according to the kind of coal or its application purpose. For instance, when the coal is intended for use singly, an oil of low boiling point such as kerosene or light oil is employed, and from the purified coal mixed with said oil, the oil is evaporated by heating or under reduced pressure, whereby the purified coal can be recovered in the single form and at the same time the oil can be recovered and reused. On the other hand, when the coal is intended for use as COM fuel, heavy oil can be employed, or heavy oil may be further added to the purified coal mixed with heavy oil. Although the viscosities of the above-cited oils are much different depending upon the kind of oil, an oil of high viscosity such as heavy oil can also be used without objection, that is, its viscosity is lowered by raising the temperature of the aqueous slurry, thereby forming oil droplets effectively.

According to an embodiment of this invention, a gas such as air or the like can also be introduced along with oil in the aqueous slurry of pulverized coal for the purpose of enhancing the buoyancy of oil. When introducing air along with oil, air bubbles with interfaces covered with oil, or hollow oil droplets are formed, and since the floating speed of these hollow oil droplets which carry coal particles, is higher than that of ordinary oil droplets which also carry coal particles, more efficient removal of ash from coal can be achieved. The air for this purpose, after flowing out of the oil tank 10, is associated with the oil pressurized by the oil pump 11 and then is fed to the bottom of the separation column 5. In this case, the installation of an air vent line at the top of the separation column 5 is necessary. The introduction of air, into the bottom of the separation column 5, is especially effective when heavy oil is used, of which specific gravity is close to that of water.

Results of carrying out this invention will be illustrated by way of the following examples:

EXAMPLE 1

A coal containing 37 wt. % of ash was ground in a ball mill to particle sizes not more than 74μ and then dispersed in water to prepare an aqueous slurry containing 10 wt % of coal. The average particle size of this pulverized coal was about 40μ. The aqueous slurry was fed into a glass column of 200 mm in inner diameter to a liquid depth of 70 cm. While stirring the lower part of slurry column so mildly that the slurry particles might not settle, kerosene was injected into the bottom portion of the glass column through a nozzle at the rate of 40 ml/min. The droplet size of the injected kerosene was about 0.3 mm. After one hour from the start of kerosene injection, a kerosene layer in which coal particles had been concentrated, was formed above the slurry layer. The coal fraction aggregated in a flock-like form in the kerosene was filtered off through a screen to recover excess kerosene. The coal fraction still containing the remaining kerosene was heated to 110° C. to evaporate this kerosene. The results of measuring the weight of coal fraction thus obtained and the ash content therein showed that the recovery yield of pure coal component was as high as 98% and the ash content was reduced to 8% in the recovered coal.

EXAMPLE 2

Using a coal containing 14.5 wt % of ash and A-heavy oil, its coal component was recovered in the same floatation way as Example 1. Since the complete removal of heavy oil from recovered coal is difficult in this case, the recovery yield of coal and the ash content in the recovered coal were determined by filtering the slurry after the floation operation had been completed, to recover the solids remaining in said slurry, and measuring the dry weight of said solids and the ash content therein. Thus, the recovery yield of pure coal component was 96% and the ash content in the recovered coal was 7.2%.

EXAMPLE 3

The same operations as Example 2 were made, but using soybean oil as an example of extracted vegetable oil. In this case, the recovery yield of pure coal component was 97% and the ash content in the recovered coal was 6.8 wt %.

EXAMPLE 4

Figure 3:
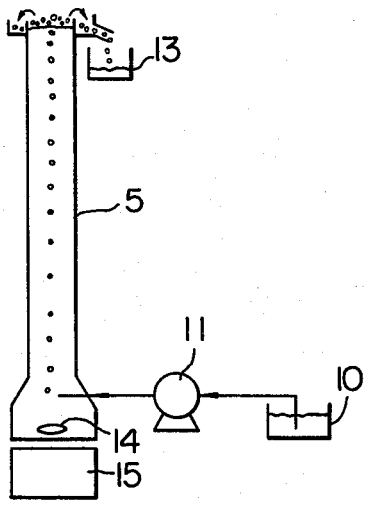
FIG. 3 is an illustration of a modified embodiment of the separation column 5 in FIG. 1.

In this example, a separation column of which a schematic view of construction is shown in FIG. 3, and a kerosene of relatively low boiling point were used. The separation column was a glass cylinder of 200 mm in inner diameter and 70 cm in height. A magnetic rotor 14 was placed on the bottom of this column to stir the slurry in the column. The amount of slurry charged was 100 ml and the concentration of coal (South Africa coal, pulverized to a particle size not exceeding 250 mesh) in the slurry was 10 wt %. The kerosene was injected at the rate of 4 ml/min from the oil tank 10 through the oil pump 11 into the bottom portion of the separation column. In FIG. 3, 15 is a motor for driving said magnetic rotor 14, and 13 is a receiving basin for the purpose of recovering the coal fraction captured by the kerosene droplets ascending the separation column 5.

Figure 4:
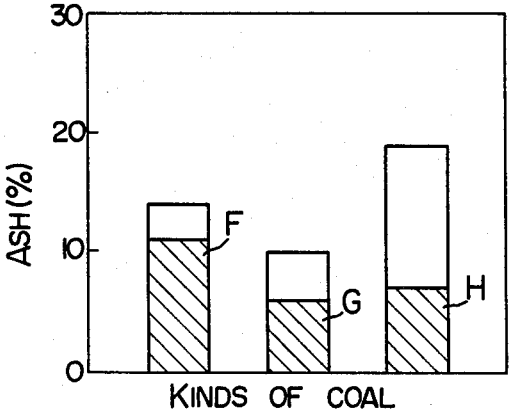
FIG. 4 is a graph to illustrate degrees of the reduction of ash contents in recovered or refined coal where the process for removing ash from coal of this invention is applied to different kinds of coal.

The coal fraction floated above the slurry layer was withdrawn after one hour from the start of kerosene injection, and dried. The results of determination of the ash content in the recovered coal were as shown in F of FIG. 4. That is, the ash content was reduced from 14 wt % in the raw coal to 11 wt % in the recovered pure coal fraction, showing a percentage of reduction of about 21%. The recovery yield of purified coal in this case was 98%. These results verified the high efficiency of the process for removing ash from coal of this invention.

When the coal fraction floated above the slurry layer was washed with water and dried, the ash content in the recovered coal was 7 wt %, i.e., the ash content was reduced by about 67% as compared with the raw coal by adding the treatment of washing with water. Thus, the confirmation was made that the efficiency of removing ash can be more improved by washing with water of the mixture of coal and oil after separation in the separation column.

EXAMPLE 5

A Chinese coal was treated for removing ash under the same conditions as Example 4. As shown by G in FIG. 4, ash content was reduced from 10 wt % for the raw coal to 6 wt % for the recovered coal, i.e., reduced by 40%. The recovery yield of purified coal was 97%.

EXAMPLE 6

A domestic coal was treated for removing ash under the same conditions as Example 4. As shown by H in FIG. 4, ash content was reduced from 19 wt % for the raw coal to 7 wt % for the recovered coal, i.e. it can be reduced by about 63%. The recovery yield of purified coal was 97%.

As illustrated by the above examples carried out by using apparatus shown in FIGS. 1 and 3, the process for removing ash from coal of this invention permits an efficient removal of ash contained in the form of fine particles in coal lumps and a very high yield recovery of purified coal by quite simple operations.

In the present process, the ash removal efficiency can be further improved by adding a dispersant such as, for example, starch or water glass to the aqueous slurry of pulverized coal to accelerate the dispersion thereof. That is to say, this dispersant acts to accelerate the separation of coal particles from those ash particles which were intimately bound in coal lumps but have come to be loosely bound to coal particles by grinding, thus preventing the contamination of recovered coal with said loosely bound ash particles.

EXAMPLE 7

In order to carry out the conventional oil agglomeration process, Blair Athol coal A (average ash content 8.2 wt %), Wark Worth coal B (average ash content 12.9 wt %), and Ermero coal C (average ash content 14.1 wt %) were ground to a particle size not exceeding 250 mesh. Each pulverized coal was mixed with water to prepare a slurry containing 10 wt % of coal. B-heavy oil was added to the slurry in an amount of about 25 wt % of the coal in the slurry. The mixture was agitated at a high speed of about 1200 rpm for 2 hours. The ash content in the coal condensed in the oil phase was analyzed and the percentage of ash removal was determined from this ash content and the ash content in the raw coal. The results were as follows:

Percentage of ash removal
Blair Athol coal: 27%
Wark Worth coal: 27%
Ermero coal: 30%

On the other hand, as an example of this invention, Ermero coal C was ground to particle sizes not exceeding 250 mesh and mixed with water to prepare a slurry containing 10 wt % of coal.

On this slurry, the following four tests were carried out using kerosene or B-heavy oil with or without injecting air:

Test 1: oil: kerosene; without air injection,
Test 2: oil: B-heavy oil; without air injection,
Test 3: oil: B-heavy oil; with air injection,
Test 4: oil: kerosene; with air injection.

In all these tests, a glass separation column of 27 mm in inner diameter and 500 mm in height was used, and the rate of oil feed was 5.6 $l/min^2$. In tests 1 and 2, the particle size of oil droplets was controlled to 2–5 mm. In tests 3 and 4, the rate of air feed, which was conducted along with oil, was 50 $l/min.m^2$.

The percentages of ash removal obtained in these tests were as follow:

Test 1, 49%; Test 2, 33%, Test 3, 53%, Test 4, 58%.

As described hereinbefore, according to this invention oil droplets are introduced into an aqueous slurry of pulverized-coal to attach pure coal, which is lipophilic, directly to the oil droplet surface and float it utilizing the buoyancy of oil droplets while leaving ashes, which are hydrophilic, in the aqueous medium, whereby ash can be effectively removed from coal.

When a gas such as air is introduced along with the oil droplets, the output of treated coal for removing ash was increased since the gas enhances the buoyancy of oil droplets.

What is claimed is:

1. A process for removing ash from coal comprising:
grinding ash containing coal to fine particles;
dispersing the particles in water to form a slurry comprising coal particles, ash particles and water;
introducing the slurry into a separating column;
introducing oil and air together from a single nozzle in the form of air bubbles with all interfaces covered with oil, said bubbles formed by the mixing of air with pressurized oil, into the lower part of the separating column, said bubbles ascending to the upper part of said separating column;
subjecting the slurry to no more than gentle stirring;
attaching the coal particles to surfaces of the ascending bubbles to form a coal containing oil phase on the upper surface of the slurry, said ash particles remaining in the slurry; and
separating the oil phase from the slurry.

2. A process for removing ash from coal of claim 1, wherein coal is ground to a maximum particle size of 100μ or less and to an average particle size of 30–40μ.

3. A process for removing ash from coal of claim 1, wherein an oil, water-insoluble, having a specific gravity less than that of water is used to form said air bubbles with interfaces covered with oil.

4. A process for removing ash from coal of claim 3, wherein sizes of said air bubbles with interfaces covered with oil are 0.1–7 mm.

5. A process for removing ash from coal of claim 1, wherein said oil is heavy oil and said gas is air.

6. A process for removing ash from coal of claim 1, wherein the oil phase containing coal and oil is led to a washing vessel and washed with water to remove any attached ash.

7. A process for removing ash from coal of claim 1, wherein the oil in the separated oil phase is evaporated either by heating or under reduced pressure to recover and reuse the oil.

8. A process according to claim 1, including:

adding a dispersant to the slurry to accelerate the separation of ash particles from coal particles.

9. A process according to claim 8, wherein the dispersant is selected from the group consisting of starch and water glass.

10. A process according to claim 1, wherein the oil is selected from the group consisting of gasoline, kerosene, light oil, heavy oil, diesel oil, carbonization liquids and vegetable oils.

11. A process according to claim 1, wherein the amount of oil introduced is in the range of 5 to 10 times the amount of coal in the slurry.

* * * * *